United States Patent [19]

Itow et al.

[11] Patent Number: 4,509,953

[45] Date of Patent: Apr. 9, 1985

[54] FUEL BLENDED WITH ALCOHOL FOR DIESEL ENGINE

[75] Inventors: Koichiro Itow; Kunihiko Komiyama, both of Oyama, Japan

[73] Assignee: Kabushiki Kaisha Komatsu Seisakusho, Tokyo, Japan

[21] Appl. No.: 499,478

[22] Filed: May 31, 1983

[30] Foreign Application Priority Data

May 31, 1982 [JP] Japan ..... 57-92377

[51] Int. Cl.[3] ..... C10L 1/08; C10L 1/10

[52] U.S. Cl. ..... 44/57; 44/53; 44/56

[58] Field of Search ..... 44/53, 56, 57

[56] References Cited

U.S. PATENT DOCUMENTS

| | | | |
|---|---|---|---|
| 1,496,810 | 6/1924 | Keyes | 44/56 |
| 1,699,355 | 1/1929 | Hammond | 44/56 |
| 2,194,495 | 3/1940 | Christensen | 44/56 |
| 4,395,267 | 7/1983 | Sweeney | 44/57 |
| 4,398,920 | 8/1983 | Guibet et al. | 44/56 |
| 4,405,337 | 9/1983 | Mori | 44/57 |

*Primary Examiner*—Y. Harris-Smith

*Attorney, Agent, or Firm*—Armstrong, Nikaido, Marmelstein & Kubovcik

[57] ABSTRACT

A fuel blended with alcohol for use in a diesel engine, which comprises a petroleum fuel, ethanol, and gasoline as a mutual solvent for said petroleum fuel and ethanol.

1 Claim, 5 Drawing Figures

FUEL BLENDED WITH ALCOHOL FOR DIESEL ENGINE

BACKGROUND OF THE INVENTION

1. Field of the Invention

This invention relates to a fuel blended with alcohol for use in a diesel engine.

2. Description of the Prior Art

A keen realization of the inevitable exhaustion of oil resources in the future has directed public attention to alcohols as a substituent fuel. A study is pursued on the use of a petroleum fuel blended with alcohol for the operation of a diesel engine. In order for a blend of a petroleum fuel such as gas oil or heavy oil with alcohol to be effectively used in the diesel engine, this blend fuel is desired to retain its behavior as a fuel stably for a long time. The blend, therefore, is required to form a dissolved fuel of the petroleum fuel in the alcohol.

Incidentally, the alcohol and the petroleum fuel such as gas oil or heavy oil exhibit poor miscibility to each other. When the two components are mixed, the resultant mixture is liable to phase separation. It is, therefore, difficult to obtain a stable blend fuel by mixing these two components.

It has been customary, therefore, to obtain a blend fuel containing about 20% by volume of ethanol by the additional incorporation therein of 5 to 10% of another alcohol like propanol as a mutual solvent.

Propanol or some other similar alcohol, however, is too expensive to be advantageously adopted as the mutual solvent for the alcohol and the petroleum fuel which are blended to produce a blend fuel economically usable in the diesel engine. Thus, the conventional method for the preparation of the blended fuel has not proved to be quite feasible.

SUMMARY OF THE INVENTION

This invention, therefore, has been directed to the development of a mutual solvent for the alcohol and the petroleum fuel which are blended to produce a blended fuel advantageously useful as alcohol blend for the diesel engine.

A major object of the present invention is to provide an economic, stable alcohol-blended fuel which excels in mutual miscibility of a petroleum fuel and an alcohol and which is useful in the diesel engine.

To accomplish the object described above, according to the present invention, there is provided an alcohol-blended fuel for the diesel engine which comprises a petroleum fuel, ethanol, and gasoline as the mutual solvent for the petroleum fuel and the ethanol.

DETAILED DESCRIPTION OF THE INVENTION

Generally when two liquids which are only partially soluble in each other are mixed, there is observed a phenomenon in which the two liquids coexist as saturated solution in two phases. In this case, the composition of the mixture depends on the prevalent temperature and pressure of the system and may be defined in terms of mutual solubility. The relation between the temperature and the mutual solubility of the mixture under a fixed pressure (such as the atmospheric pressure) is expressed by a mutual solubility curve.

Also in the blended fuel consisting of an alcohol and a petroleum fuel, since the mutual solubility of the alcohol and the petroleum fuel is inferior, the mixture obtained by the blending of the two components tends to induce the phenomenon of phase separation.

Figure 1:
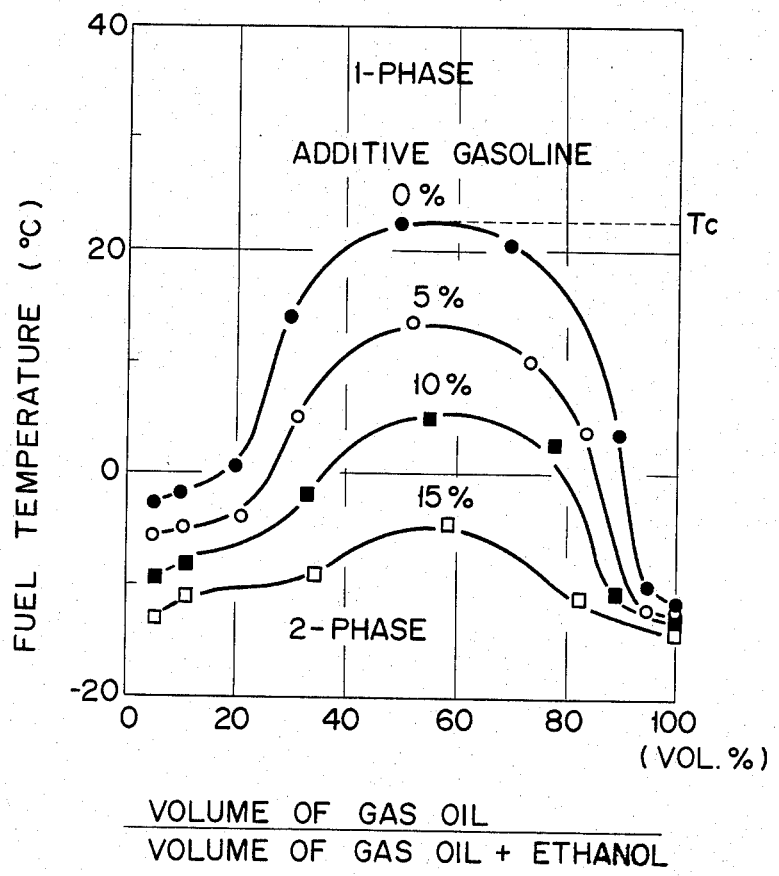
FIG. 1 is a graph showing the effect of the amount of gasoline added upon the mutual solubility curve of gas oil (specific gravity, $\gamma=0.82$) and anhydrous ethanol in the resultant blended fuel.
Figure 2:
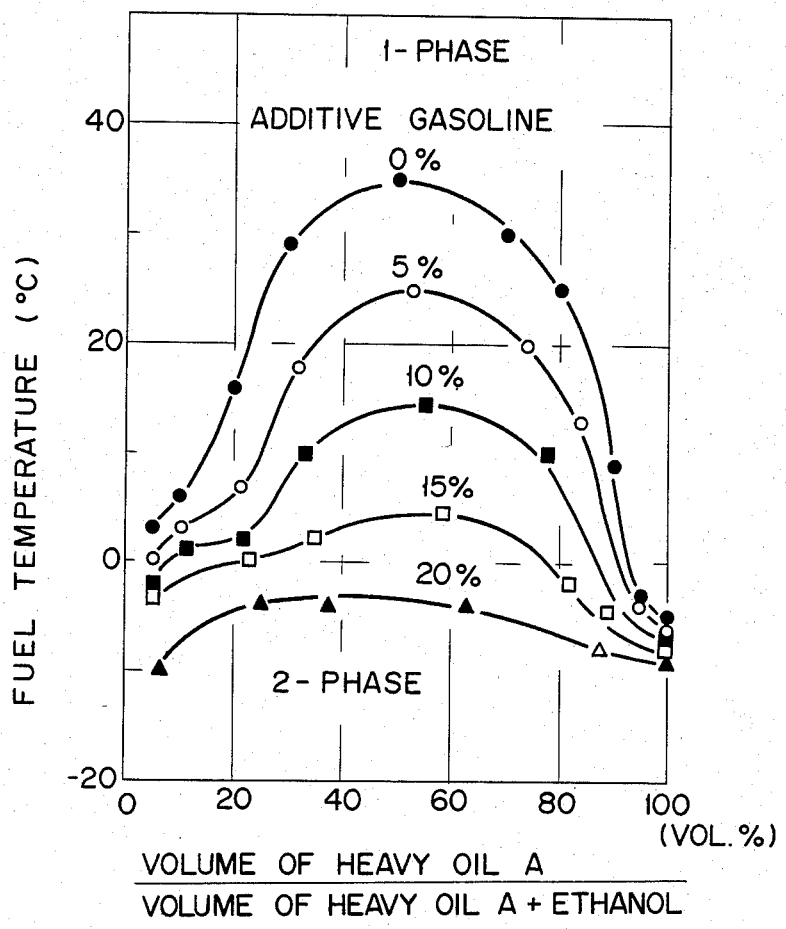
FIG. 2 is a graph showing the effect of the amount of gasoline added upon the mutual solubility curve of heavy oil, A($\gamma=0.846$) and anhydrous ethanol in the resultant blended fuel.

The mutual solubility curve between gas oil and ethanol is expressed by the curve for 0% of gasoline addition in the graph of FIG. 1 and the mutual solubility curve between heavy oil, A, and ethanol by the curve for 0% of gasoline addition in the graph of FIG. 2 respectively.

In the case of the mutual solubility curve between gas oil and ethanol (the curve for 0% of gasoline addition in the graph of FIG. 1), for example, the upper portion of the curve represents a dissolved phase (one phase) and the lower portions of the curve represent the separated phases (two phases). It is noted from the graph that at a fuel temperature of 10° C., the fuel has two separated phases when the mixing ratio of gas oil falls in the range of 27 to 87% by volume and these two phases are both saturated solutions, one consisting of 27% by volume of gas oil and 73% by volume of ethanol and the other consisting of 87% by volume of gas oil and 13% by volume of ethanol. The mutual solubility curve, as any other mutual solubility curve, has its own maximum value at the temperature, $T_c$ (which is 23° C. in the case of the curve under discussion). It is further noted that when the mixture temperature is increased beyond this temperature $T_c$, the mixture of gas oil with ethanol becomes a perfect one-phase solution without reference to its composition. This particular temperature, $T_c$, is defined as the critical solution temperature for the mixture. It has been known that when two components which have such low mutual solubility as described above are mixed, the mutual solubility of the components in the resultant mixture is improved and the critical solution temperature of the mixture is lowered by incorporating into the mixture a third component capable of simultaneously dissolving the first two components. This third component is generally referred to as a mutual solvent.

In order for the blended fuel of a petroleum fuel with an alcohol to be economical and, at the same time, capable of retaining its behavior stably for a long time, it is necessary to develop a mutual solvent which is inexpensive and also is capable of lowering the critical solution temperature of the blended fuel.

A search for substances which may be usable as mutual solvents for blended fuels of alcohols with petroleum fuels has revealed the following data.

TABLE 1

| Name of substance | Chemical formula | Specific gravity | Melting point | Boiling point |
|---|---|---|---|---|
| | Particulars of mutual solvents | | | |
| Gasoline | — | 0.73 | — | — |
| Benzene | $C_6H_6$ | 0.88 | 5.4 | 80.5 |
| Iso-octane | $C_8H_{18}$ | 0.69 | — | 99.3 |
| Propanol | $C_3H_7OH$ | 0.80 | −126.2 | 97.2 |
| Pentanol | $C_5H_{11}OH$ | 0.81 | −78.5 | 138.1 |
| Octanol | $C_8H_{17}OH$ | 0.82 | −16 | 194.0 |
| Decanol | $C_{10}H_{21}OH$ | 0.825 | −6 | 232.9 |
| Dodecanol | $C_{12}H_{25}OH$ | 0.83 | 24 | 259.0 |
| Cetanol | $C_{16}H_{33}OH$ | 0.835 | 49 | 189.0 |
| Ethyl ether | $(C_2H_5)_2O$ | 0.72 | −116.3 | 34.6 |

Figure 4:
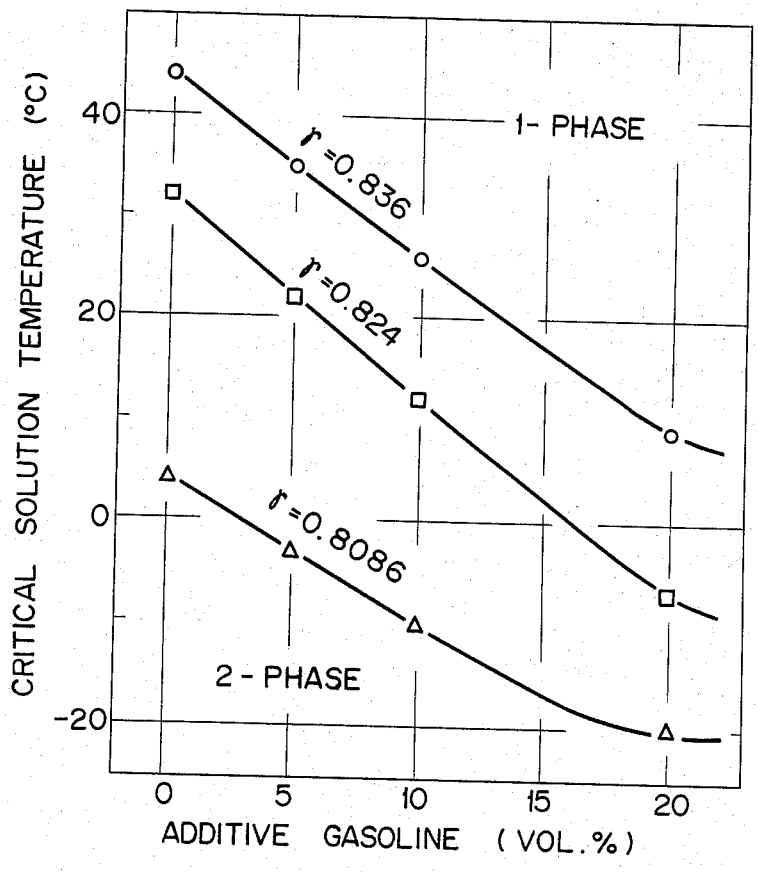
FIG. 4 is a graph showing the effect exerted upon the critical solution temperature, in relation to the amount of gasoline added, by the specific gravity ($\gamma$) of gas oil in the blended fuel consisting of gas oil, anhydrous ethanol, and gasoline as a mutual solvent therefor.
Figure 5:
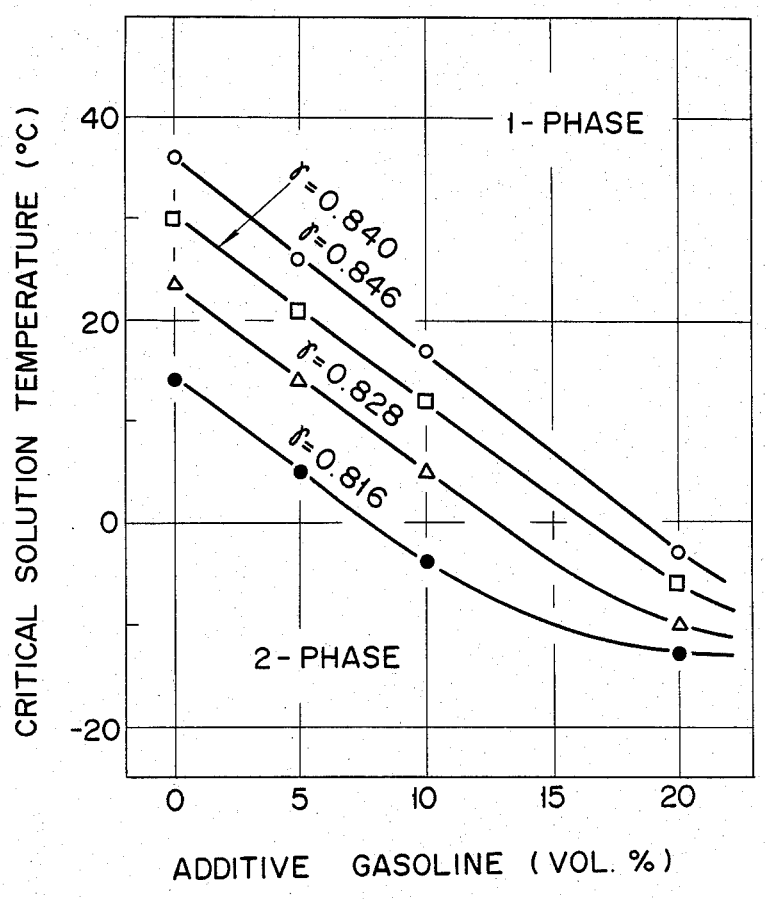
FIG. 5 is a graph showing the effect exerted upon the critical solution temperature, in relation to the amount of gasoline added, by the specific gravity ($\gamma$) of heavy oil, A, in the blended fuel consisting of heavy oil, A, anhydrous ethanol, and gasoline as a mutual solvent therefor.

It is noted from FIG. 4 and FIG. 5 that generally when the critical solution temperature falls in any range exceeding the level of −10° C., the critical solution temperature linearly decreases in proportion as the mixing ratio of the aforementioned mutual solvent with the blended fuel consisting of the alcohol and the petroleum fuel and that the rate of this decrease in the critical solution temperature is variable from one mutual solvent to another. As the value for evaluating the improvement of the mutual solubility of the alcohol and the petroleum fuel by the addition of the mutual solvent, there is adopted the value δ(°C./%), which represents the drop in the critical solution temperature to be brought about by the addition of the mutual solvent in an amount of 1% by volume. This value is designated as "mutual solubility improvement index."

The mutual solubility improvement index, δ, obtained by the incorporation of a varying mutual solvent in Table 1above into the blended fuel consisting of ethanol or methanol as the alcohol and gas oil or heavy oil, A, (corresponding to heavy oil, Type 1, according to JIS K-2205) as the petroleum fuel is shown in Table 2 below.

TABLE 2

| Mutual solvent | Mutual solubility improvement index, δ, by varying mutual solvent | | | |
|---|---|---|---|---|
| | Gas oil (γ = 0.824) | | Heavy oil, A (γ = 0.846) | |
| | Ethanol | Methanol | Ethanol | Methanol |
| Gasoline | 1.80 | 2.90 | 2.00 | — |
| Benzene | 2.60 | 3.55 | 2.70 | — |
| Iso-octane | 1.40 | — | 1.80 | — |
| Ethyl ether | — | 4.59 | — | — |
| Propanol | 1.95 | 3.25 | 1.68 | 3.11 |
| Pentanol | 3.77 | 4.71 | 3.07 | 4.48 |
| Octanol | 5.56 | 5.90 | 4.44 | 5.89 |
| Decanol | 6.37 | 6.76 | 5.18 | 6.56 |
| Dodecanol | 6.70 | 7.35 | 5.90 | 7.20 |
| Cetanol | 6.87 | 7.45 | — | — |

It is noted from Table 2 that the values of the mutual solubility improvement index, δ, are higher with such higher alcohols as cetanol, dodecanol, and decanol and lower with alcohols of smaller numbers of carbon atoms and such hydrocarbons as benzene, gasoline, and iso-octane, although they are more or less variable with the particular type of alcohol or petroleum fuel.

Of the blended fuels enumerated above, the methanol-based blended fuels are decisively inferior to the ethanol-based blended fuels in terms of mutual solubility. Since higher alcohols and other similar substances having higher values of mutual solubility improvement index are expensive, they do not permit preparation of inexpensive blended fuels. Thus, adoption of these substances as mutual solvents is hardly feasible. In contrast, the ethanol-based blended fuels exhibit rather advantageous mutual solubility between ethanol and petroleum fuels. They, accordingly, permit adoption of mutual solvents having lower mutual solubility. For example, they permit use of gasoline which is inexpensive and widely available. As an economic blended fuel for use in the diesel engine, therefore, it is advantageous to adopt an ethanol-based blended fuel from the standpoint of both stability and economy.

Figure 3:
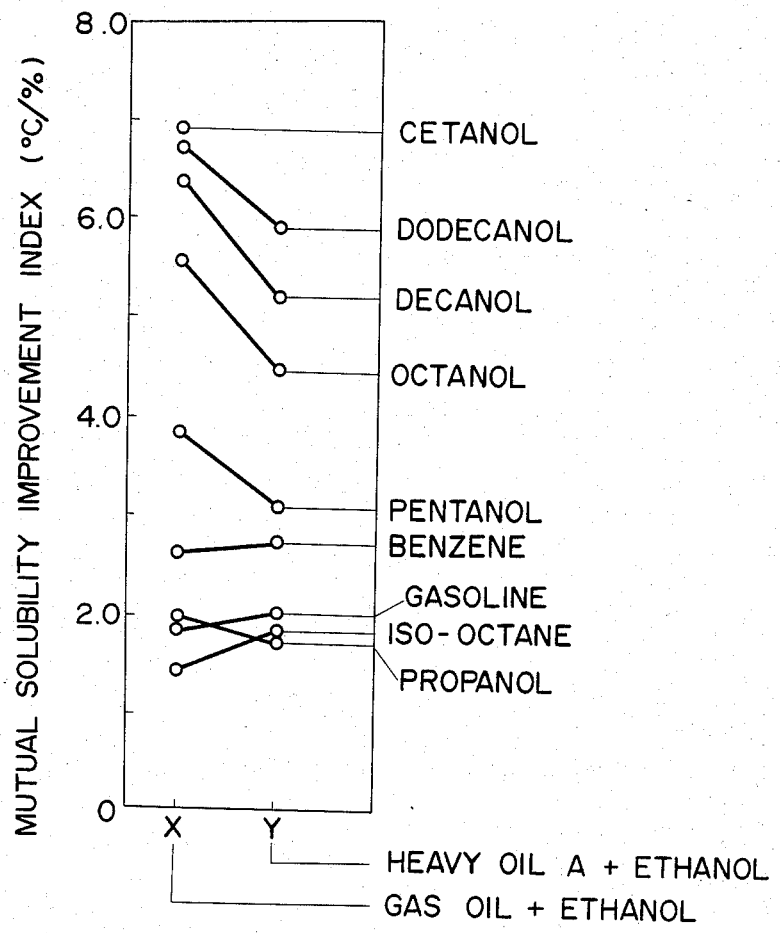
FIG. 3 is a graph showing the miscibility improvement index, $\delta$(°C./%), of a varying mutual solvent in the blended fuel of gas oil with ethanol and in the blended fuel of heavy oil, A with ethanol.

FIG. 3 shows the mutual solubility improvement index exhibited by a varying mutual solvent shown in Table 2 in the blended fuel using ethanol as its alcohol component.

It is noted from FIG. 3 that the mutual solubility improvement index of gasoline is favorably comparable with that of propanol heretofore used in the blended fuel of ethanol with gas oil. Besides this advantage, gasoline is less expensive than propanol. By adopting gasoline as the mutual solvent for ethanol and a petroleum fuel in the resultant blended fuel, therefore, the blended fuel of ethanol with a petroleum fuel which has to date proved to be hardly feasible can be materialized advantageously.

By adopting gasoline as a mutual solvent for ethanol and a petroleum fuel in accordance with the present invention, there can be obtained a blended fuel for the diesel engine which excels in mutual solubility of the components and in stability, and economy as well.

It is noted from the mutual solubility curves of varying blended fuels shown in the graphs of FIG. 1 and FIG. 2 that the critical solution temperatures decrease with the increasing amounts of gasoline added as the mutual solvent. This conclusion is clearly supported by the data of FIG. 4 and FIG. 5. As shown in FIG. 4 and FIG. 5, the critical solution temperature decreases substantially linearly in proportion as the mixing ratio of gasoline is increased. When the critical solution temperature is lowered to a certain extent, however, any further increase in the amount of gasoline added does not manifest any noticeable increase in the effect. Thus, the mixing ratio of gasoline as the mutual solvent is generally sufficient in the range not exceeding 30%. It is noted from FIG. 4 and FIG. 5 that the critical solution temperature is also affected by the specific gravity, γ, of the petroleum fuel. The mixing ratio of gasoline, therefore, may be suitably selected in due consideration of the quality of the petroleum fuel used for the blended fuel.

The mixing ratio of the petroleum fuel in the blended fuel thereof with ethanol is in the range of 10 to 95% by volume, preferably from 70 to 90% by volume.

Examples of the petroleum fuel suitable for use in the blended fuel include heavy oil and gas oil both of varying grades.

What we claim is:

1. A fuel for use in a diesel engine, which consisting essentially of:

(a) 70–90% by volume of a petroleum fuel selected from the group consisting of gas oil and heavy oil, said volume being based on the volume of petroleum fuel and ethyl alcohol;

(b) ethyl alcohol in an amount of 10–30% by volume based on the volume of petroleum fuel and ethyl alcohol; and (c) gasoline as a mutual solvent for said petroleum fuel and ethyl alcohol in an amount up to 30% by volume based on the total volume of the fuel, said gasoline being present in an amount sufficient to maintain the fuel in a single phase solution.

* * * * *